US007101647B2

(12) United States Patent
Azuma et al.

(10) Patent No.: US 7,101,647 B2
(45) Date of Patent: Sep. 5, 2006

(54) ELECTROPHOTOSENSITIVE MATERIAL

(75) Inventors: Jun Azuma, Osaka (JP); Kazunari Hamasaki, Osaka (JP); Daisuke Kuboshima, Osaka (JP); Hisakazu Honma, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 193 days.

(21) Appl. No.: 10/667,905

(22) Filed: Sep. 23, 2003

(65) Prior Publication Data

US 2004/0058257 A1 Mar. 25, 2004

(30) Foreign Application Priority Data

Sep. 24, 2002 (JP) ..... 2002-277778

(51) Int. Cl.
*G03G 5/06* (2006.01)

(52) U.S. Cl. ..... 430/56; 430/78; 430/133

(58) Field of Classification Search ..... 430/56, 430/78, 133
See application file for complete search history.

(56) References Cited

U.S. PATENT DOCUMENTS

| | | | | | |
|---|---|---|---|---|---|
| 5,077,161 | A | * | 12/1991 | Law | 430/78 |
| 5,087,540 | A | * | 2/1992 | Murakami et al. | 430/78 |
| 5,190,839 | A | * | 3/1993 | Fujimaki et al. | 430/78 |
| 5,328,788 | A | * | 7/1994 | Omote et al. | 430/78 |
| 5,576,131 | A | * | 11/1996 | Takai et al. | 430/78 |
| 5,656,407 | A | * | 8/1997 | Kawahara | 430/78 |
| 5,858,594 | A | * | 1/1999 | Notsu et al. | 430/78 |
| 6,465,143 | B1 | * | 10/2002 | Tanaka et al. | 430/78 |
| 2004/0214101 | A1 | * | 10/2004 | Suzuki | 430/78 |

FOREIGN PATENT DOCUMENTS

| | | | |
|---|---|---|---|
| GB | 1 376 343 | | 12/1974 |
| JP | 03033858 | A * | 2/1991 |
| JP | 03037663 | A * | 2/1991 |
| JP | 07-175241 | | 7/1995 |
| JP | 07-199493 | | 8/1995 |
| JP | 09-034148 | | 2/1997 |
| JP | 2000-047406 | | 2/2000 |
| JP | 2000-047407 | | 2/2000 |
| JP | 2000-147809 | | 5/2000 |
| JP | 2000-147810 | | 5/2000 |
| JP | 2000-239553 | | 9/2000 |
| JP | 2000-242011 | | 9/2000 |
| JP | 2001-123087 | | 5/2001 |
| JP | 2002-055470 | | 2/2002 |

OTHER PUBLICATIONS

Patent Abstract of Japan, vol. 015, No. 176, Publication No. 03037663, Publication Date: Feb. 19, 1991.

* cited by examiner

*Primary Examiner*—Christopher Rodee
(74) *Attorney, Agent, or Firm*—Smith, Gambrell & Russell, LLP

(57) ABSTRACT

The present invention provides an electrophotosensitive material which realizes uniform dispersion of phthalocyanines in a photosensitive layer and has high sensitivity to a digital light source, and also excellent in charge stability under the high temperature atmosphere, weatherability and NOx resistance. The electrophotosensitive material is produced by forming a single-layer type or multi-layer type photosensitive layer containing phthalocyanine as an electric charge generating material, an electric charge transferring material, a predetermined insoluble azo pigment and a predetermined binder resin on a conductive substrate and using, as the insoluble azo pigment, an insoluble azo pigment having no OH group in the molecule wherein (i) an absorbance in an absorption wavelength range of phthalocyanine is ⅓ or less of an absorbance of the phthalocyanine in the wavelength range, or (ii) an absorbance in a wavelength range of an exposure light source of an image forming apparatus is ⅓ or less of an absorbance of the phthalocyanine in the wavelength range.

5 Claims, 3 Drawing Sheets

ELECTROPHOTOSENSITIVE MATERIAL

BACKGROUND OF THE INVENTION

The present invention relates to an electrophotosensitive material and, more particularly, to a digital electrophotosensitive material which is used in image forming apparatuses such as electrophotographic copying machine, facsimile and laser beam printer.

In image forming apparatuses such as electrophotographic copying machine, facsimile and laser beam printer, various organic photosensitive materials having the sensitivity in a wavelength range of a light source used in said apparatuses. Although a digital technique has recently been introduced into image forming apparatus, a red semiconductor laser (LD) and a light emitting diode (LED) are mainly used as the light source for digital image forming apparatus and light having a long wavelength of about 600 to 830 nm (orange light, red light and light in a near infrared range) are emitted from the light source and, therefore, it is strongly required to develop an organic photosensitive material which is excellent in sensitivity in these wavelength ranges.

Intense interest has been shown towards phthalocyanines (TiOPc) as an electric charge generating material having high sensitivity in a near infrared range. Particularly, a multi-layer type electrophotosensitive material using α type or Y type titanyl phthalocyanine (α-TiOPc, Y-TiOPc) or a mixed crystal of TiOPc and hydroxy metal phthalocyanine as an electric charge generating material has already been put into practical use.

On the other hand, a single-layer type electrophotosensitive material containing an electric charge generating material and an electric charge transferring material in a single photosensitive layer has the following advantages. That is, the single-layer type electrophotosensitive material is excellent in productivity because of its simple layer construction, as compared with a multi-layer type electrophotosensitive material comprising a conductive substrate and an electric charge generating layer and an electric charge transferring layer formed separately on the conductive substrate, and can inhibit the occurrence of layer defects during the formation of the photosensitive layer, and also the single-layer type electrophotosensitive material has improved optical characteristics because of less interface between layers and can be used as both of positive and negative charging type electrophotosensitive materials.

Therefore, there have been made various studies on the single-layer type electrophotosensitive material using the above-mentioned phthalocyanines as the electric charge generating material. However, there arises a problem that a single-layer type electrophotosensitive material having high sensitivity can not be obtained when using α-TiOPc, Y-TiOPc or a mixed crystal of TiOPc and hydroxymetal phthalocyanine as the electric charge generating material.

The reason is as follows. That is, a binder resin such as polycarbonate, polyarylate, polyester, polystyrene or polymethacrylate ester used in the formation of the photosensitive layer has low affinity with TiOPc or the mixed crystal and a dispersion medium of a coating solution for formation of a photosensitive layer is limited to a non-alcoholic solvent such as tetrahydrofuran, dioxane, dioxolane, toluene or methylene chloride taking account of the solubility of various materials constituting the photosensitive layer and, furthermore, the non-alcoholic solvent is a poor solvent to TiOPc or the mixed crystal.

Also there arises a problem that it becomes difficult to form a uniform photosensitive layer as a result of the occurrence of coagulative precipitation of TiOPc because of low dispersibility in the dispersion medium, and that the crystal form of TiOPc is transferred to a crystal form which is different from an expected crystal form after preparation of a dispersion because of low stability with a lapse of time in the dispersion medium.

Patent Documents 1 to 5 describe a coating solution prepared by incorporating TiOPc and specific azo pigments taking account of the dispersibility of a TiOPc-containing coating solution for formation of a photosensitive layer, and a single-layer type electrophotosensitive material (or photoconductor) using the same. Also Patent Documents 6 to 11 describe a single-layer type electrophotosensitive material comprising TiOPc and specific azo pigments.

However, the coating solution described in Patent Documents 1 to 5 still has a problem that the coating solution has poor storage stability. Furthermore, the electrophotosensitive material (photoconductor) described in Patent Documents 1 to 11 has a problem that it is inferior in charge stability and NOx resistance and such a problem drastically occurred under the high temperature atmosphere.

Patent Document 1: Japanese Published Unexamined Patent Application (Kokai Tokkyo Koho) No. 2000-47406 (see claims 1 and 2 and paragraph numbers [0013] to [0030])

Patent Document 2: Japanese Published Unexamined Patent Application (Kokai Tokkyo Koho) No. 2000-47407 (see claims 1 and 2 and paragraph numbers [0013] to [0029])

Patent Document 3: Japanese Published Unexamined Patent Application (Kokai Tokkyo Koho) No. 2000-147810 (see claims 1 and 2 and paragraph numbers [0021] to [0036])

Patent Document 4: Japanese Published Unexamined Patent Application (Kokai Tokkyo Koho) No. 2001-123087 (see claim 5 and paragraph numbers [0013] to [0026] and [0031])

Patent Document 5: Japanese Published Unexamined Patent Application (Kokai Tokkyo Koho) No. 2000-239553 (see claim 1 and paragraph numbers [0014] to [0027])

Patent Document 6: Japanese Published Unexamined Patent Application (Kokai Tokkyo Koho Hei) No. 7-175241 (see claim 1 and paragraph number [0004])

Patent Document 7: Japanese Published Unexamined Patent application (Kokai Tokkyo Koho Hei) No. 9-34148 (see claim 1 and paragraph number [0004])

Patent Document 8: Japanese Published Unexamined Patent application (Kokai Tokkyo Koho) No. 2000-147809 (see claim 2 and paragraph numbers [0020] to [0035])

Patent Document 9: Japanese Published Unexamined Patent Application (Kokai Tokkyo Koho) No. 2000-242011 (see claim 2 and paragraph numbers [0021] to [0040])

Patent Document 10: Japanese Published Unexamined Patent Application (Kokai Tokkyo Koho) No. 2002-55470 (see claims 1 and 2 and paragraph numbers [0022] to [0036])

Patent Document 11: Japanese Published Unexamined Patent Application (Kokai Tokkyo Koho Hei) No. 7-199493 (see claim 1 and paragraph numbers [0028] to [0029])

Thus, it is required to obtain an electrophotosensitive material, which has high sensitivity to a digital light source and also has high performances, by preparing a coating solution for formation of a photosensitive layer, which is excellent in dispersibility of phthalocyanines, stability in a dispersed state and stability with a lapse of time, and using the coating solution.

An object of the present invention is to provide an electrophotosensitive material which realizes uniform dispersion of phthalocyanines in a photosensitive layer and has high sensitivity to a digital light source, and also excellent in charge stability under the high temperature atmosphere, weatherability and NOx resistance, and preferably a single-layer type electrophotosensitive material.

Any azo pigments used in the inventions described in Patent Documents 1 to 11 are selected on the assumption that they exhibit the sensitivity in a broad visible range. Although a coupler residue including the naphthol structure portion is used in the azo pigments, the coagulability of the azo pigment itself is enhanced by the presence of an OH group having high polarity and also coagulative precipitation of the pigment occurs with a lapse of time in the coating solution for formation of a photosensitive layer because of low affinity with a binder resin such as polycarbonate.

Furthermore, it is considered that the OH group at the naphthol structure portion serves as an adsorption portion of an active gas such as NOx and, therefore, there arises a problem that an electrophotosensitive material containing the azo pigments is inferior in NOx resistance.

Since the azo pigments exhibit the sensitivity in a broad visible range, not only TiOPc incorporated as the electric charge generating material in the photosensitive layer, but also the azo pigments exhibit electric charge generating ability. However, since both of TiOPc and the azo pigments exhibit the electric charge generating ability, heat carrier is liable to occur and electric charge retention tends to be lowered. This leads to deterioration of the charge stability under the high temperature atmosphere.

Therefore, the present inventors have employed phthalocyanines having excellent sensitivity in a near infrared range during intensive study to achieve the above-mentioned object, and have studied intensively with a policy of incorporation of azo pigments in a single-layer or multi-layer type photosensitive layer for the purpose of improving the dispersibility of the coating solution for formation of a photosensitive layer.

As a result, they have found a new fact that there can be provided an electrophotosensitive material which realizes uniform dispersion of phthalocyanines in a photosensitive layer and has high sensitivity to a digital light source, and also excellent in charge stability under the high temperature atmosphere, weatherability and NOx resistance, and particularly a single-layer type electrophotosensitive material when using, as the azo pigments, (I) an insoluble azo pigment having no OH group such as hydroxyl group or carboxyl group wherein an absorbance in an absorption wavelength range of an electric charge generating material (phthalocyanine) is ⅓ or less of an absorbance in the wavelength of the electric charge generating material, or (II) an insoluble azo pigment having no OH group such as hydroxyl group or carboxyl group wherein an absorbance in a wavelength range of an exposure light source is ⅓ or less of an absorbance of the electric charge generating material (phthalocyanine) in the wavelength range in an image forming apparatus using the electrophotosensitive material of the present invention. Thus, the present invention has been completed.

SUMMARY OF THE INVENTION

To achieve the above-mentioned object, a first electrophotosensitive material of the present invention comprises a conductive substrate and a photosensitive layer containing an electric charge generating material, an electric charge transferring material, an insoluble azo pigment and a binder resin provided on the conductive substrate, wherein the electric charge generating material is phthalocyanine and the in soluble azo pigment has no OH group in the molecule, and an absorbance of the insoluble azo pigment in an absorption wavelength range of the electric charge generating material is ⅓ or less of an absorbance in the wavelength of the electric charge generating material.

The electrophotosensitive material of the present invention is characterized in that the binder resin is at least one resin selected from the group consisting of polycarbonate, polyester, polyallylate, polystyrene and polymethacrylate ester.

To achieve the above-mentioned object, a second electrophotosensitive material of the present invention comprises a conductive substrate and a photosensitive layer containing an electric charge generating material, an electric charge transferring material, an insoluble azo pigment and a binder resin provided on the conductive substrate, wherein the electric charge generating material is phthalocyanine and the insoluble azo pigment has no OH group in the molecule, and an absorbance of the insoluble azo pigment in a wavelength range of an exposure light source of an image forming apparatus is ⅓ or less of an absorbance in the wavelength of the electric charge generating material.

In the first and second electrophotosensitive materials, the binder resin is preferably at least one resin selected from the group consisting of polycarbonate, polyester, polyarylate, polystyrene and polymethacrylate ester.

According to the first and second electrophotosensitive materials, since electric charge generating materials such as phthalocyanine and a specific insoluble azo pigment are incorporated in the material constituting the photosensitive layer, the dispersibility of phthalocyanine in a coating solution for formation of a photosensitive layer can be enhanced and also uniform dispersion of phthalocyanine can be realized in the photosensitive layer formed by using the coating solution. These effects are particularly remarkable in case phthalocyanine is titanyl phthalocyanine.

Since the specific insoluble azo pigment does not have an OH group such as hydroxyl group or carboxyl group in the molecule and a polar portion capable of serving as an adsorption portion of an active gas such as NOx does not exist, NOx resistance and charge stability under the high temperature atmosphere of the electrophotosensitive material are not lowered even if the insoluble azo pigment is incorporated in the photosensitive layer.

As described above, the specific insoluble azo pigment is characterized in that:

(i) an absorbance in an absorption wavelength range of an electric charge generating material (phthalocyanine) is low, for example, it is ⅓ or less of an absorbance of the phthalocyanine in the wavelength range, or (ii) an absorbance in a wavelength range of an exposure light source in an image forming apparatus is low, for example, it is ⅓ or less of an absorbance in the wavelength range.

In other words, since the specific insoluble azo pigment is inactive in a sensitivity range of phthalocyanine as the electric charge generating material and exerts less influence on electric charge generating ability, the charge stability of the electrophotosensitive material is not lowered. Such an effect is particularly remarkable under the high temperature atmosphere.

In the first and second electrophotosensitive materials of the present invention, the phthalocyanine as the electric charge generating material is preferably α type titanyl phthalocyanine having each main diffraction peak at a Bragg angle (2 θ±0.2°)=7.6° and 28.6° in an X-ray diffraction spectrum, or Y type titanyl phthalocyanine having a main diffraction peak at a Bragg angle (2 θ±0.2°)=27.2 in view of an improvement in sensitivity of the photosensitive material.

In the present invention, Cu—Kα characteristic X-ray (wavelength: 1.54 Å) was used in the analysis of an X-ray diffraction spectrum.

In the first and second electrophotosensitive materials of the present invention, the phthalocyanine as the electric charge generating material is preferably titanyl phthalocyanine and does not have an endothermic peak except for a peak associated with evaporation of adsorbed water in differential scanning calorimetry during heating from 50° C. to 400° C.

In the results of the measurement due to differential scanning calorimetry (DSC), no endothermic peak observed except for a peak associated with evaporation of adsorbed water within a range from 50° C. to 400° C. shows that the phthalocyanine hardly cause crystal transfer and is stable.

The phthalocyanine itself is excellent in dispersibility in the binder resin and storage stability and also further improves the dispersibility in the binder resin when incorporated in the photosensitive layer, together with the insoluble azo pigment.

In the first and second electrophotosensitive materials of the present invention, the photosensitive layer is preferably obtained by forming a film using a coating solution containing the electric charge generating material, the electric charge transferring material, the insoluble azo pigment and the binder resin, and the coating solution is preferably at least one organic solvent selected from the group consisting of tetrahydrofuran, dioxane, dioxolane, cyclohexanone, toluene, xylene, dichloromethane, dichloroethane and chlorobenzene.

By using the above-mentioned organic solvents as a dispersion medium of the coating solution for formation of a photosensitive layer, the dispersibility of the electric charge generating material (phthalocyanine) and the insoluble azo pigment in the coating solution, and the photosensitive layer formed by the coating solution can be improved.

In the first and second electrophotosensitive materials of the present invention, the insoluble azo pigment is preferably a mono azo pigment represented by the general formula (1):

(1)

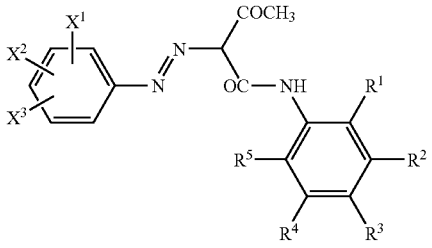

in the formula (1), $X^1$ to $X^3$ are the same or different and represent a nitro group, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, a group: —$CONHR^6$, or a group: —$SO_2NHPh$, $R^1$ to $R^5$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^2$ and $R^3$ may be combined with each other to form an ureylene group, $R^6$ and $R^7$ are the same or different and represent a hydrogen atom, an alkyl group having 1 to 3 carbon atoms, or a phenyl group, and Ph represents a phenyl group;

a disazo pigment represented by the general formula (2):

(2)

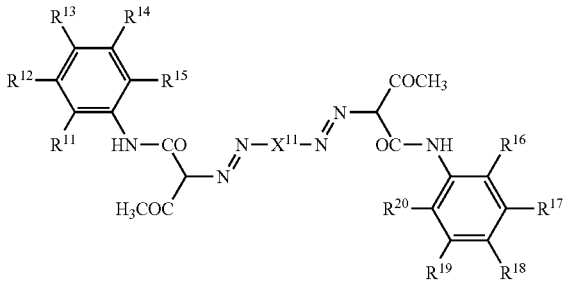

in the formula (2), $X^{11}$ represents the general formula (21) or the general formula (22):

(21)

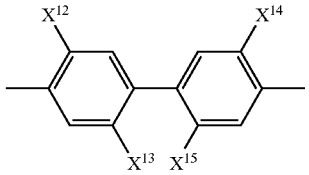

(22)

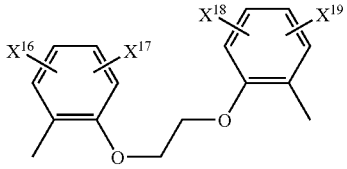

(in the formula (21), $X^{12}$ to $X^{15}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms and, in the formula (22), $X^{16}$ to $X^9$ are the same or different and represent a chlorine atom, an alkyl group having 1 to 3 carbon atoms, a perfluoroalkyl group having 1 to 3 carbon atoms, or an alkoxy group having 1 to 3 carbon atoms), $R^{11}$ to $R^{20}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{12}$ and $R^{13}$ and/or $R^{17}$ and $R^{18}$ may be combined with each other to form an ureylene group, and $R^7$represents a hydrogen atom, an alkyl group having 1 to 3 carbon atoms, or a phenyl group;

a disazo pigment represented by the general formula (3):

(3)

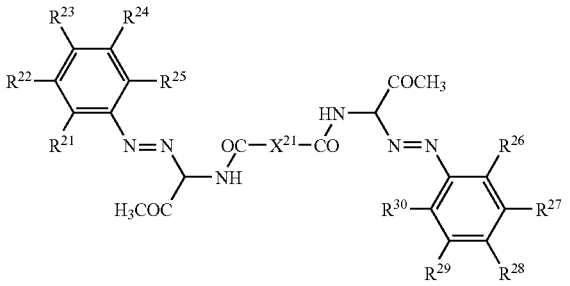

in the formula (3), $X^{21}$ represents the general formula (31) or the general formula (32):

(31)

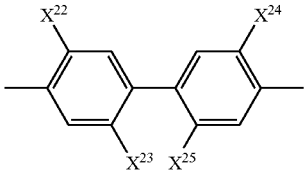

(32)

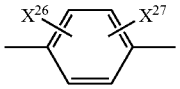

(in the formula (31), $X^{22}$ to $X^{25}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms and, in the formula (32), $X^{26}$ and $X^{27}$ are the same or different and represent a chlorine atom, an alkyl group having 1 to 3 carbon atoms, a perfluoroalkyl group having 1 to 3 carbon atoms, or an alkoxy group having 1 to 3 carbon atoms), $R^{21}$ to $R^{30}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{22}$ and $R^{23}$ and/or $R^{27}$ and $R^{28}$ may be combined with each other to form an ureylene group, and $R^7$represents a hydrogen atom, an alkyl group having 1 to 3 carbon atoms, or a phenyl group;

a disazo pigment represented by the general formula (4):

(4)

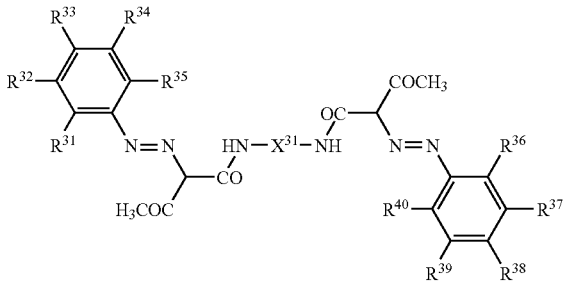

in the formula (4), $X^{31}$ represents the general formula (41) or the general formula (42):

(41)

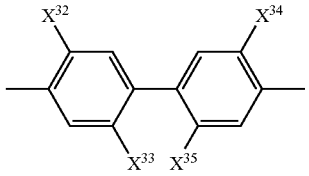

(42)

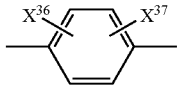

(in the formula (41), $X^{32}$ to $X^{35}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms and, in the formula (42), $X^{36}$ and $X^{37}$ are the same or different and represent a chlorine atom, an alkyl group having 1 to 3 carbon atoms, a perfluoroalkyl group having 1 to 3 carbon atoms, or an alkoxy group having 1 to 3 carbon atoms), $R^{31}$ to $R^{40}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{32}$ and $R^{33}$ and/or $R^{37}$ and $R^{38}$ may be combined with each other to form an ureylene group, and $R^7$ represents a hydrogen atom, an alkyl group having 1 to 3 carbon atoms or a phenyl group;

a disazo condensed pigment represented by the general formula (5):

(5)

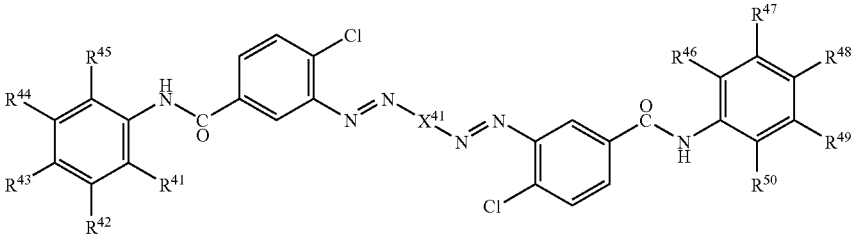

in the formula (5), $X^{41}$ represents the general formula (51):

(51)

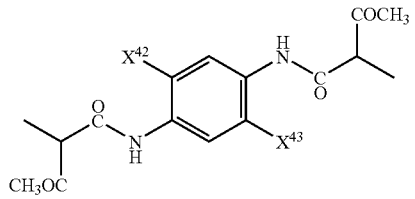

(in the formula (51), $X^{42}$ and $X^{43}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms), $R^{41}$ to $R^{50}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{42}$ and $R^{43}$ and/or $R^{47}$ and $R^{48}$ may be combined with each other to form an ureylene group, and $R^7$ is as defined above; or a disazo condensed pigment represented by the general formula (6):

(6)

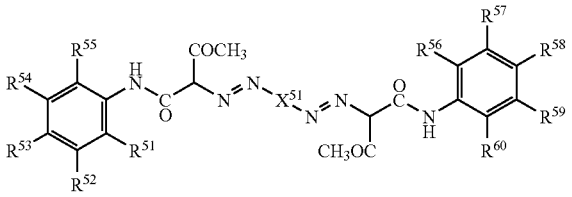

in the formula (6), $X^{51}$ represents the formula (61):

(61)

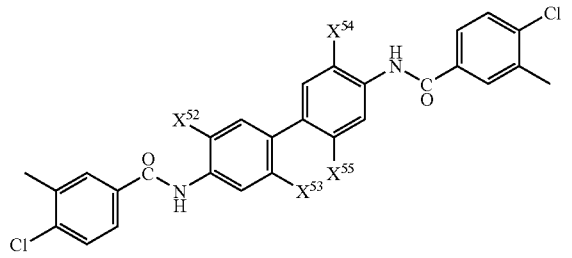

(in the formula (61), $X^{52}$ to $X^{55}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms), $R^{51}$ to $R^{60}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{52}$ and $R^{53}$ and/or $R^{57}$ and $R^{58}$ may be combined with each other to form an ureylene group, and $R^7$ is as defined above.

The insoluble azo pigment has not an OH group such as hydroxyl group or carboxyl group in the molecule and also has no sensitivity in a near infrared range, or it is characterized in that:

(i) an absorbance in an absorption wavelength range of an electric charge generating material (phthalocyanine) is low, for example, it is ⅓ or less of an absorbance of the phthalocyanine in the wavelength range, or (ii) an absorbance in a wavelength range of an exposure light source in an image forming apparatus is low, for example, it is ⅓ or less of an absorbance in the wavelength range of the electric charge generating material (phthalocyanine).

Therefore, the above-mentioned insoluble azo pigment is remarkably preferable in view of the achievement of an object of the present invention, which is to provide an electrophotosensitive material which realizes uniform dispersion of phthalocyanines in a photosensitive layer and has high sensitivity to a digital light source, and also excellent in charge stability under the high temperature atmosphere, weatherability and NOx resistance.

The first and second electrophotosensitive materials are preferably single-layer type electrophotosensitive materials comprising a conductive substrate and a single photosensitive layer containing an electric charge generating material, an electric charge transferring material, an insoluble azo pigment and a binder resin provided on the conductive substrate.

DETAILED DESCRIPTION OF THE INVENTION

Figure 1:
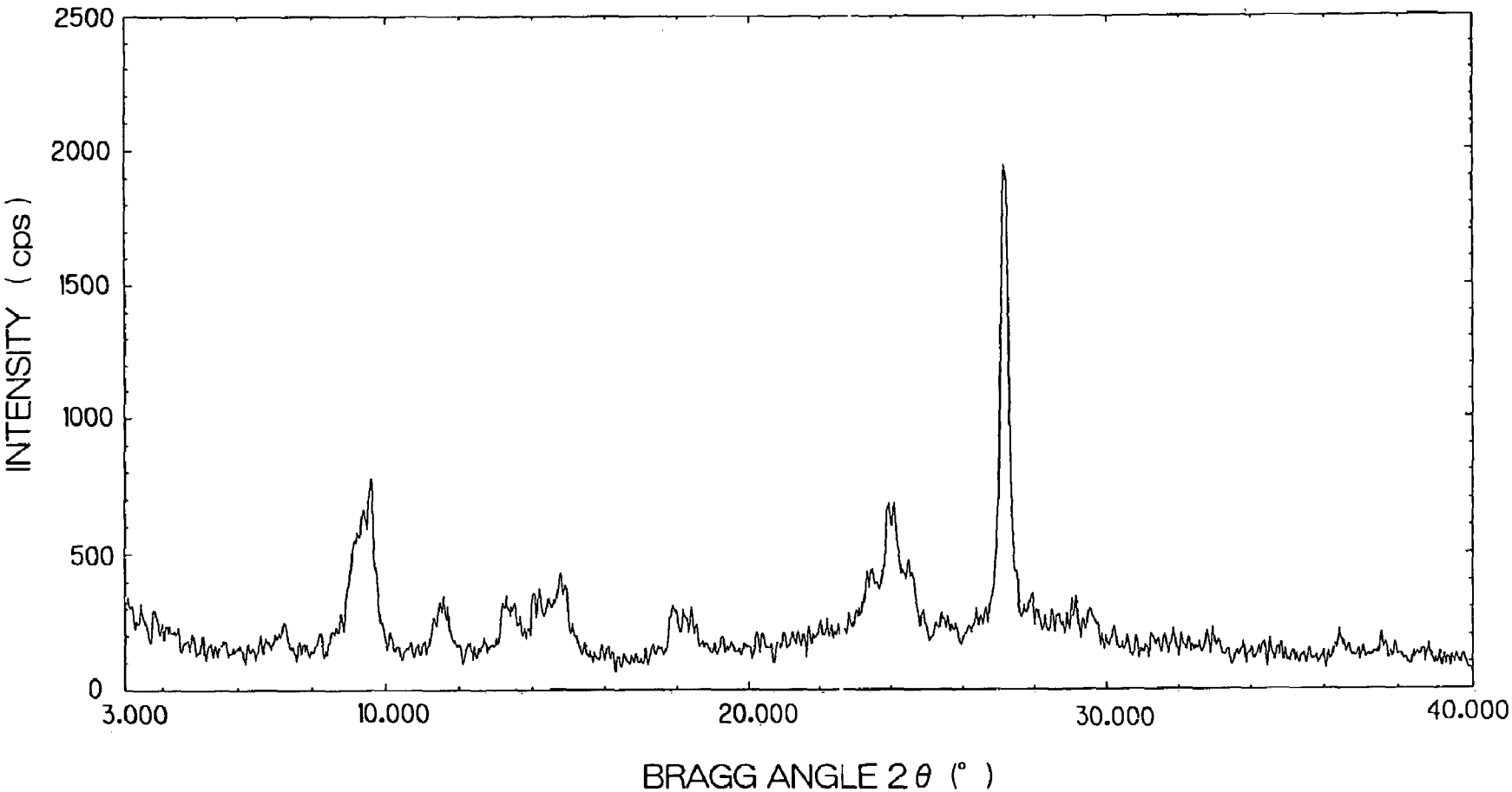
FIG. 1 is a graph showing an X-ray diffraction spectrum of Y type TiOPc used in the Examples.

The electrophotosensitive material of the present invention will be described in detail.

[Electric Charge Generating Material]

In the electrophotosensitive material of the present invention, phthalocyanine is used as the electric charge generating material.

The phthalocyanine varies depending on the kind of coordination metal and, for example, metal-free phthalocyanine, titanyl phthalocyanine, copper phthalocyanine, aluminum chloro phthalocyanine, chloroindium phthalocyanine, magnesium phthalocyanine, zinc phthalocyanine, and vanadyl phthalocyanine are known. Individual phthalocyanine is further classified into several kinds according to its crystal form. As the phthalocyanine which can be used in the present invention, the kind and crystal form of the coordination metal are not specifically limited and conventionally known any phthalocyanines can be used. Among these phthalocyanines, titanyl phthalocyanine (TiOPc) having excellent sensitivity in a near infrared range is preferably used.

As TiOPc, for example, those having various crystal forms such as α type TiOPc, Y type TiOPc, β type TiOPc and C type TiOPc are known. TiOPc, which can be used in the present invention, is not specifically limited and conventionally known TiOPc having various crystal forms can be used.

Among these, α type titanyl phthalocyanine having each main diffraction peak at a Bragg angle (2 θ±0.2°)=7.6° and 28.6° in an X-ray diffraction spectrum, and Y type titanyl phthalocyanine having a main diffraction peak at a Bragg angle (2 θ±0.2°)=27.2 are preferably used in the present invention because these titanyl phthalocyanines have extremely high sensitivity in a near infrared range and are advantageous to obtain a single-layer type electrophotosensitive material having high sensitivity.

Among preferable examples of TiOPc, Y type titanyl phthalocyanine having each main diffraction peak at a Bragg angle (2 θ±0.2°)=27.2 has a problem such as poor stability in an organic solvent such as tetrahydrofuran contained in the coating solution for formation of a photosensitive layer.

Therefore, such phthalocyanine is preferably titanyl phthalocyanine which does not have an endothermic peak except for a peak associated with evaporation of adsorbed water in differential scanning calorimetry during heating from 50° C. to 400° C.

This titanyl phthalocyanine can be prepared by two methods (1) and (2) described below (see claims 5 and 6 and paragraph numbers [0029] to [0039] of Japanese Published Unexamined Patent Application (Kokai Tokkyo Koho) No. 2001-181531).

(1) A method comprising a pigmentation pretreatment step of adding a titanyl phthalocyanine in an aqueous organic solvent, stirring under heating for a fixed time, and allowing the resulting solution to stand for a fixed time under the conditions at a temperature lower than that of the above stirring process, thereby to stabilize the solution; and a pigmentation step of removing the aqueous organic solvent from the solution to obtain a crude crystal of the titanylphthalocyanine, dissolving the crude crystal of the titanyl phthalocyanine in a solvent, adding dropwise the solution in a poor solvent to recrystallize the titanyl phthalocyanine compound, and then subjecting the recrystallized compound to milling treatment in a non-aqueous solvent, with water contained therein.

(2) A method comprising a pigmentation pretreatment step of adding a titanyl phthalocyanine in an aqueous organic solvent, stirring under heating for a fixed time, and allowing the resulting solution to stand for a fixed time under the conditions at a temperature lower than that of the above stirring process, thereby to stabilize the solution; a step of removing the aqueous organic solvent from the solution to obtain a crude crystal of the titanyl phthalocyanine, and treating the crude crystal of the titanyl phthalocyanine according to acid-paste method; and a step of subjecting a low-crystalline titanyl phthalocyanine compound obtained by the above step to milling treatment, with water contained therein.

[Insoluble Azo Pigment]

The insoluble azo pigment used in the electrophotosensitive material of the present invention is characterized in that:

(I) the insoluble azo pigment has no OH group such as hydroxyl group or carboxyl group wherein an absorbance in an absorption wavelength range of an electric charge generating material (phthalocyanine) is ⅓ or less of an absorbance in the wavelength of the electric charge generating material (that is, the insoluble azo pigment has no sensitivity in the absorption wavelength range of the electric charge generating material (phthalocyanine), or has very weak sensitivity), or (II) the insoluble azo pigment has no OH group such as hydroxyl group or carboxyl group wherein an absorbance in a wavelength range of an exposure light source is ⅓ or less of an absorbance of the electric charge generating material (phthalocyanine) in the wavelength range in an image forming apparatus using the electrophotosensitive material of the present invention (that is, the insoluble azo pigment has no sensitivity in the absorption wavelength range of the exposure light source, or has very weak sensitivity).

Even if such an insoluble azo pigment is used, it does not inhibit electric charge generating ability due to phthalocyanine and only exerts an effect of improving the dispersibility of phthalocyanine in a photosensitive layer or a coating solution for formation of the photosensitive layer.

Examples of the insoluble azo pigment, which satisfies the above-mentioned conditions, include mono azo pigment represented by the general formula (1), disazo pigments represented by the general formulas (2) to (4), and disazo condensed pigment represented by the general formula (5) or (6). These azo pigments may be incorporated alone in the photosensitive layer of the electrophotosensitive material of the present invention, or a mixture of two or more kinds of them may be incorporated therein. (Mono azo pigment represented by the general formula (1))

In the mono azo pigment represented by the general formula (1), $X^1$ to $X^3$ may be the same or different substituents.

Examples of the substituent corresponding to $X^1$ to $X^3$ include nitro group, chlorine atom, alkyl group having 1 to 3 carbon atoms (for example, methyl group, ethyl group, n-propyl group, or isopropyl group), perfluoroalkyl group having 1 to 3 carbon atoms (wherein all hydrogen atoms in the alkyl group are replaced by fluorine atoms), alkoxy group having 1 to 3 carbon atoms (for example, methoxy group, ethoxy group, n-propoxy group, or isopropoxy group), alkoxycarbonyl group having 1 to 2 carbon atoms (for example, methoxycarbonyl group or ethoxycarbonyl group), group: —$CONHR^6$ (for example, carbamoyl group; $R^6$ represents a hydrogen atom, an alkyl group having 1 to 3 carbon atoms, or a phenyl group), and group: —$SO_2NHPh$ (for example, N-phenylsulfamoyl group).

In the mono azo pigment represented by the general formula (1), $R^1$ to $R^5$ may be the same or different substituents.

Examples of the substituent corresponding to $R^1$ to $R^5$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and group: —$NHCOR^7$ (for example, acetamide group or benzamide group; $R^7$ represents a hydrogen atom, an alkyl group having 1 to 3 carbon atoms, or a phenyl group). On the basis of the carbon atom attached to the nitrogen atom of the benzene ring on which $R^1$ to $R^5$ are substituted, carbon atoms at the meta- and para-positions (for example, $R^2$ and $R^3$) may be combined with each other to form an ureylene group represented by the formula:

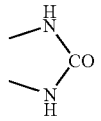

Specific examples of the mono azo pigment represented by the general formula (1) are shown in Table 1, together with Color Index Number (C.I. No.).

TABLE 1

| C.I. No. | $X^1$–$X^3$ | $R^1$–$R^5$ |
|---|---|---|
| ※Monoazo pigment of the general formula (1) | | |
| Pigment Yellow | | |
| 1 | 2: —$NO_2$, 4: —$CH_3$ | — |
| 2 | 2: —$NO_2$, 4: —Cl | $R^1$, $R^3$: —$CH_3$ |
| 3 | 2: —$NO_2$, 4: —Cl | $R^1$: —Cl |
| 4 | 4: —$NO_2$ | — |
| 5 | 2: —$NO_2$ | — |
| 6 | 2: —$NO_2$, 4: —Cl | — |
| 9 | 2: —$NO_2$, 4: —$CH_3$ | — |
| 49 | 2: —$CH_3$, 4: —Cl | $R^1$, $R^4$: —$OCH_3$, $R^3$: —Cl |
| 65 | 2: —$NO_2$, 4: —$OCH_3$ | $R^1$: —$OCH_3$ |
| 73 | 2: —$NO_2$, 4: —Cl | $R^1$: —$OCH_3$ |
| 74 | 2: —$OCH_3$, 4: —$NO_2$ | $R^1$: —$OCH_3$ |
| 75 | 2: —$NO_2$, 4: —Cl | $R^3$: —$OC_2H_5$ |
| 97 | 2, 5: —$OCH_3$<br>4: —$SO_2NHPh$ | $R^1$, $R^4$: —$OCH_3$, $R^3$: —Cl |
| 98 | 2: —$NO_2$; 4: —Cl | $R^1$: —$CH_3$, $R^3$: —Cl |
| 116 | 2: —Cl, 5: —$CONH_2$ | $R^4$: —$NHCOCH_3$ |
| 120 | 3, 5: —$COOCH_3$ | $R^2$–$R^3$: ureylene |
| 154 | 2: —$CF_3$ | $R^2$–$R^3$: ureylene |
| Pigment Orange | | |
| 1 | 2: —$NO_2$, 4: —$OCH_3$ | $R^1$: —$CH_3$ |
| 36 | 2: —$NO_2$, 4: —Cl | $R^2$–$R^3$: ureylene |

In Table 1, abbreviations described in the respective columns "$X^1$–$X^3$" and "$R^1$–$R^5$" are as follows.

"—$NO_2$" denotes a nitro group, "—Cl" denotes a chlorine atom, "—$CH_3$" s a methyl group, "—$CF_3$" denotes a perfluoromethyl group, "—$OCH_3$" denotes a methoxy group, "—$OC_2H_5$" denotes an ethoxy group, "—$COOCH_3$" denotes a methoxycarbonyl group, "—$SO_2NHPh$" denotes an N-phenylsulfamoyl group, and "—$CONH_2$" denotes a carbamoyl group, respectively.

"2:", "4:" and "5:" in the column "$X^1$–$X^3$" denote the positions of the substituent on the benzene ring, and respectively denote "2-position", "4-position" and "5-position" on the basis of the carbon atom attached to the nitrogen atom. "2,5:" and"3,5:" denote that two same groups are substituted on the benzene ring, and denote that the substitution positions are "2- and 5-positions" and "3- and 5-positions" on the basis of the carbon atom.

"$R^2$–$R^3$: ureylene" in the column "$R^1$–$R^5$" denotes that $R^2$ and $R^3$ are combined with each other to form an ureylene group. Among $R^1$ to $R^5$, non-described groups denote that a hydrogen atom is substituted and "—" denotes that any of $R^1$ to $R^5$ are hydrogen atoms.

(Disazo Pigment Represented by the General Formula (2))

In the disazo pigment represented by the general formula (2), either of divalent groups represented by the general formula (21) and the general formula (22) is selected as $X^{11}$.

In the divalent group represented by the general formula (21), $X^{12}$ to $X^{15}$ may be the same or different substituents. Examples of the substituent corresponding to $X^{12}$ to $X^{15}$ include hydrogen atom, chlorine atom, alkyl group having 1 to 3 carbon atoms (supra), perfluoroalkyl group having 1 to 3 carbon atoms (supra), and alkoxy group having 1 to 3 carbon atoms (supra).

In the divalent group represented by the general formula (22), $X^{16}$ to $X^{19}$maybe the same or different substituents. Examples of the substituent corresponding to $X^{16}$ to $X^{19}$ include chlorine atom, alkyl group having 1 to 3 carbon atoms (supra), perfluoroalkyl group having 1 to 3 carbon atoms (supra), and alkoxy group having 1 to 3 carbon atoms (supra).

In the disazo pigment represented by the general formula (2), $R^{11}$ to $R^{20}$ maybe the same or different substituents. Examples of the substituent corresponding to $R^{11}$ to $R^{20}$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and group: —$NHCOR^7$ (supra). On the basis of the carbon atom attached to the nitrogen atom of the benzene ring on which $R^{11}$ to $R^{20}$ are substituted, carbon atoms at the meta- and para-positions (for example, $R^{12}$ and $R^{13}$, and $R^{17}$ and $R^{18}$) may be combined with each other to form an ureylene group.

Specific examples of the disazo pigment represented by the general formula (2) are shown in Tables 2 and 3, together with Color Index Number (C.I. No.).

TABLE 2

| C.I. No. | $X^{12}$, $X^{14}$ | $X^{13}$, $X^{15}$ | $R^{11}$–$R^{20}$ |
|---|---|---|---|
| ※Disazo pigment of the general formula (2), $X^{11}$: general formula (21) | | | |
| Pigment Yellow | | | |
| 12 | —Cl | —H | — |
| 13 | —Cl | —H | $R^{11}$, $R^{13}$ , $R^{16}$, $R^{18}$: —$CH_3$ |
| 14 | —Cl | —H | $R^{11}$, $R^{16}$: —$CH_3$ |
| 15 | —$OCH_3$ | —Cl | $R^{11}$, $R^{13}$, $R^{16}$, $R^{18}$: —$CH_3$ |
| 17 | —Cl | —H | $R^{11}$, $R^{16}$: —$OCH_3$ |
| 55 | —Cl | —H | $R^{13}$, $R^{18}$: —$CH_3$ |
| 81 | —Cl | —Cl | $R^{11}$, $R^{13}$, $R^{16}$, $R^{18}$: —$CH_3$ |
| 83 | —Cl | —H | $R^{11}$, $R^{14}$, $R^{16}$, $R^{19}$: —$OCH_3$<br>$R^{13}$, $R^{18}$: —Cl |
| 87 | —Cl | —H | $R^{11}$, $R^{14}$, $R^{16}$, $R^{19}$: —$OCH_3$ |
| 113 | —Cl | —Cl | $R^{11}$, $R^{16}$: —$CH_3$<br>$R^{13}$, $R^{18}$: —Cl |
| 170 | —Cl | —H | $R^{13}$, $R^{18}$: —$OCH_3$ |
| 171 | —Cl | —H | $R^{11}$, $R^{16}$: —$CH_3$<br>$R^{13}$, $R^{18}$: —Cl |
| 172 | —Cl | —H | $R^{11}$, $R^{16}$: —$OCH_3$<br>$R^{14}$, $R^{19}$: —Cl |
| Pigment Orange | | | |
| 16 | —$OCH_3$ | —H | — |

TABLE 3

| C.I. No. | $X^{16}$, $X^{17}$ | $X^{18}$, $X^{19}$ | $R^{11}$–$R^{20}$ |
|---|---|---|---|
| ※Disazo pigment of the general formula (2), $X^{11}$: general formula (22) | | | |
| Pigment Yellow | | | |
| 180 | — | — | $R^{12}$–$R^{13}$, $R^{17}$–$R^{18}$: ureylene |

In Tables 2 and 3, among abbreviations described in the respective columns "$X^{12}$, $X^{14}$", "$X^{13}$, $X^{15}$" and "$R^{11}$—$R^{20}$", "—Cl" and "—$OCH_3$" are as defined in Table 1. "—H" denotes a hydrogen atom. "—" in the column "$X^{13}$, $X^{15}$" denotes that a corresponding group is absent. "$R^{12}$–$R^{13}$, $R^{17}$–$R^{18}$: ureylene" in the column $R^{11}$–$R^{20}$" denotes that $R^{12}$ and $R^{13}$ and $R^{17}$ and $R^{18}$ are combined with each other to form an ureylene group. Among $R^{11}$ to $R^{20}$, non-described groups denote that a hydrogen atom is substituted and "—" denotes that any of $R^{11}$ to $R^{20}$ are hydrogen atoms.

(Disazo Pigment Represented by the General Formula (3))

In the disazo pigment represented by the general formula (3), either of divalent groups represented by the general formula (31) and the general formula (32) is selected as $X^{21}$.

In the divalent group represented by the general formula (31), $X^{22}$ to $X^{25}$ maybe the same or different substituent. Examples of the substituent corresponding to $X^{22}$ to $X^{24}$ include hydrogen atom, chlorine atom, alkyl group having 1 to 3 carbon atoms (supra), perfluoroalkyl group having 1 to 3 carbon atoms (supra), and alkoxy group having 1 to 3 carbon atoms (supra).

In the divalent group represented by the general formula (32), $X^{26}$and $X^{27}$ maybe the same or different substituents. Examples of the substituent corresponding to $X^{26}$ and $X^{27}$ include chlorine atom, alkyl group having 1 to 3 carbon atoms (supra), perfluoroalkyl group having 1 to 3 carbon atoms (supra), and alkoxy group having 1 to 3 carbon atoms (supra).

In the disazo pigment represented by the general formula (3), $R^{21}$ to $R^{30}$ maybe the same or different substituents. Examples of the substituent corresponding to $R^{21}$ to $R^{30}$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and group: —$NHCOR^7$ (supra) On the basis of the carbon atom attached to the nitrogen atom of the benzene ring on which $R^{21}$ to $R^{30}$ are substituted, carbon atoms at the meta- and para-positions (for example, $R^{22}$ and $R^{23}$, and $R^{27}$ and $R^{28}$) may be combined with each other to form an ureylene group.

Specific examples of the disazo pigment represented by the general formula (3) are shown in Table 4, together with Color Index Number (C.I. No.).

TABLE 4

| ·X·Disazo pigment of the general formula (3), $X^{21}$: general formula (31) | | | |
|---|---|---|---|
| C.I. No. | $X^{22}$, $X^{24}$ | $X^{23}$, $X^{25}$ | $R^{21}$–$R^{30}$ |
| Pigment Yellow | | | |
| 16 | —$CH_3$ | —H | $R^{21}$, $R^{23}$, $R^{26}$, $R^{28}$: —Cl |
| 77 | —$CH_3$ | —H | $R^{21}$, $R^{26}$: —$CH_3$<br>$R^{24}$, $R^{29}$: —Cl |

In Table 4, among abbreviations described in the respective columns "$X^{22}$, $X^{24}$", "$X^{23}$, $X^{25}$" and "$R^{21}$–$R^{30}$", any of "—H", "—Cl" and "—$CH_3$" are as defined in Tables 1 to 3. Among $R^{21}$ to $R^{30}$, groups which are not described in the column "$R^{21}$—$R^{30}$" denote that a hydrogen atom is substituted.

(Disazo Pigment Represented by the General Formula (4))

In the disazo pigment represented by the general formula (4), either of divalent groups represented by the general formula (41) and the general formula (42) is selected as $X^{31}$.

In the divalent group represented by the general formula (41), $X^{32}$ to $X^{35}$maybe the same or different substituents. Examples of the substituent corresponding to $X^{32}$ to $X^{35}$ include hydrogen atom, chlorine atom, alkyl group having 1 to 3 carbon atoms (supra), perfluoroalkyl group having 1 to 3 carbon atoms (supra), and alkoxy group having 1 to 3 carbon atoms (supra).

In the divalent group represented by the general formula (42), $X^{36}$ and $X^{37}$ maybe the same or different substituents. Examples of the substituent corresponding to $X^{36}$ and $X^{37}$ include chlorine atom, alkyl group having 1 to 3 carbon atoms (supra), perfluoroalkyl group having 1 to 3 carbon atoms (supra), and alkoxy group having 1 to 3 carbon atoms (supra).

In the disazo pigment represented by the general formula (4), $R^{31}$ to $R^{40}$ maybe the same or different substituents. Examples of the substituent corresponding to $R^{31}$ to $R^{40}$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and group: —$NHCOR^7$ (supra). On the basis of the carbon atom attached to the nitrogen atom of the benzene ring on which $R^{21}$ to $R^{30}$ are substituted, carbon atoms at the meta- and para-positions (for example, $R^{32}$ and $R^{33}$, and $R^{37}$ and $R^{38}$) may be combined with each other to form an ureylene group.

Specific examples of the disazo pigment represented by the general formula (4) are shown in Table 5, together with Color Index Number (C.I. No.).

TABLE 5

| ·X·Disazo pigment of the general formula (4), $X^{31}$: general formula (42) | | | |
|---|---|---|---|
| C.I. No. | $X^{36}$ | $X^{37}$ | $R^{31}$–$R^{40}$ |
| Pigment Yellow | | | |
| 155 | — | — | $R^{31}$, $R^{34}$, $R^{36}$, $R^{39}$: —$COOCH_3$ |

In Table 5, among abbreviations described in the respective columns "$X^{36}$", "$X^{37}$" and "$R^{31}$–$R^{40}$", any of "$CH_3OCO$" and "—" are as defined in Tables 1 to 4. Among $R^{31}$ to $R^{40}$, groups which are not described in the column "$R^{31}$–$R^{40}$" denote that a hydrogen atom is substituted.

(Disazo Condensed Pigment Represented by the General Formula (5))

In the disazo condensed pigment represented by the general formula (5), $X^{41}$ corresponds to a divalent group represented by the general formula (51).

In the divalent group represented by the general formula (51), $X^{42}$ and $X^{43}$ maybe the same or different substituents. Examples of the substituent corresponding to $X^{42}$ and $X^{43}$ include hydrogen atom, chlorine atom, alkyl group having 1 to 3 carbon atoms (supra), perfluoroalkyl group having 1 to 3 carbon atoms (supra), and alkoxy group having 1 to 3 carbon atoms (supra).

In the disazo condensed pigment represented by the general formula (5), $R^{41}$ to $R^{50}$ may be the same or different substituents. Examples of the substituent corresponding to $R^{41}$ to $R^{50}$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and group: —$NHCOR^7$ (supra). On the basis of the carbon atom attached to the nitrogen atom of the benzene ring on which $R^{41}$ to $R^{50}$ are substituted, carbon atoms at the meta- and para-positions (for example, $R^{42}$ and $R^{43}$, and $R^{47}$ and $R^{48}$) may be combined with each other to form an ureylene group.

Specific examples of the disazo pigment represented by the general formula (5) are shown in Table 6, together with Color Index Number (C.I. No.).

TABLE 6

X Disazo condensed pigment of the general formula (5)

| C. I. No. | $X^{42}$ | $X^{43}$ | $R^{41}$–$R^{50}$ |
|---|---|---|---|
| Pigment Yellow | | | |
| 93 | Cl | Cl | $R^{41}$, $R^{46}$: —$CH_3$, $R^{42}$, $R^{47}$: —Cl |
| 94 | Cl | Cl | $R^{41}$, $R^{46}$: —$CH_3$, $R^{44}$, $R^{49}$: —Cl |
| 95 | $CH_3$ | $CH_3$ | $R^{41}$, $R^{46}$: —$CH_3$, $R^{44}$, $R^{49}$: —Cl |

In Table 6, among abbreviations described in the respective columns "$X^{42}$", "$X^{43}$" and "$R^{41}$–$R^{50}$", any of "—Cl" and "—$CH_3$" are as defined in Tables 1 to 5. Among $R^{41}$ to $R^{50}$, groups which are not described in the column "$R^{41}$–$R^{50}$" denote that a hydrogen atom is substituted.

(Disazo Condensed Pigment Represented by the General Formula (6))

In the disazo condensed pigment represented by the general formula (6), $X^{51}$ corresponds to a divalent group represented by the general formula (61).

In the divalent group represented by the general formula (61), $X^{52}$ to $X^{55}$ maybe the same or different substituents. Examples of the substituent corresponding to $X^{52}$ to $X^{55}$ include hydrogen atom, chlorine atom, alkyl group having 1 to 3 carbon atoms (supra), perfluoroalkyl group having 1 to 3 carbon atoms (supra), and alkoxy group having 1 to 3 carbon atoms (supra).

In the disazo condensed pigment represented by the general formula (6), $R^{51}$ to $R^{60}$ may be the same or different substituents. Examples of the substituent corresponding to $R^{51}$ to $R^{60}$ include hydrogen atom, chlorine atom, alkyl group having 1 to 3 carbon atoms (supra), perfluoroalkyl group having 1 to 3 carbon atoms (supra), alkoxy group having 1 to 3 carbon atoms (supra), alkoxycarbonyl group having 1 to 2 carbon atoms (supra), and a group: —NH-$COR^7$ (supra). On the basis of the carbon atom attached to the nitrogen atom of the benzene ring on which $R^{51}$ to $R^{60}$ are substituted, carbon atoms at the meta- and para-positions (for example, $R^{62}$ and $R^{63}$, and $R^{67}$ and $R^{68}$) may be combined with each other to form an ureylene group.

Specific examples of the disazo pigment represented by the general formula (6) are shown in Table 7.

TABLE 7

X Disazo condensed pigment of the general formula (6)

| Compound No. | $X^{52}$, $X^{54}$ | $X^{53}$, $X^{55}$ | $R^{51}$–$R^{60}$ |
|---|---|---|---|
| 6-1 | — | — | — |

In Table 7, "—" described in the respective columns "$X^{52}$, $X^{54}$", "$X^{53}$, $X^{55}$" and "$R^{51}$–$R^{60}$" is as defined in Tables 1 to 6. Among $R^{51}$ to $R^{60}$, groups which are not described in the column "$R^{51}$—$R^{60}$" denote that a hydrogen atom is substituted.

[Ratio of Electric Charge Generating Material and Insoluble Azo Pigment]

A ratio of the phthalocyanine to the insoluble azo pigment is not specifically limited, but is preferably set within a range from 1:0.01 to 1:100 in terms of a weight ratio in view of an improvement in dispersibility of phthalocyanine and an improvement in sensitivity of the electrophotosensitive material.

A ratio of the phthalocyanine to the insoluble azo pigment is preferably from 1:0.1 to 1:10 (weight ratio), and more preferably from 1:0.75 to 1:1.25 (weight ratio), within the above range.

[Binder Resin]

In the electrophotosensitive material of the present invention, as the binder resin for dispersing the respective components such as electric charge generating material, electric charge transferring material, and insoluble azo pigment in the photosensitive layer, at least one resin selected from the group consisting of polycarbonate, polyester, polyarylate, polystyrene and polymethacrylate ester is used.

These binder resins are excellent in compatibility with the electric charge transferring material and does not have a portion capable of hindering electric charge transferability of the electric charge transferring material in its chemical structure. An electrophotosensitive material having higher sensitivity can be obtained by using these binder resins

[Electric Charge Transferring Material]

Examples of the electric charge transferring material used in the electrophotosensitive material of the present invention include conventionally known electron transferring materials and/or hole transferring materials.

The use of either or both of the electron transferring material and the hole transferring material is selected according to the layer structure and charge polarity of the photosensitive material. In case a charge-transfer complex of the electron transferring material and the hole transferring material is not formed, both materials are preferably incorporated after mixing them.

(Electron Transferring Material)

Examples of the electron transferring material, which can be used in the present invention, include various compounds having electron acceptability, for example, diphenoquinone derivative, benzoquionone derivative, anthraquinone derivative, malononitrile derivative, thiopyran compound, trinitrothioxanthone derivative, fluorenone derivative such as 3,4,5,7-tetranitro-9-fluorenone derivative, dinitroanthracene derivative, dinitroacridine derivative, nitroanthraquinone derivative, dinitroanthraquinone derivative, tetracyanoethylene, 2,4,8-trinitrothoxanthone, dinitrobenzene, dinitroanthracene, dinitroacridine, nitroanthraquinone, dinitroanthraquinone, succinic anhydride, maleic anhydride, and dibromomaleic anhydride.

These electron transferring materials may be used alone, or two or more kinds of them may be used in combination.

(Hole Transferring Material)

Examples of the hole transferring material, which can be used in the present invention, include nitrogen-containing cyclic compounds and condensed polycyclic compounds, for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenantolylenediamine derivative, oxadiazole compounds such as 2,5-di(4-methylaminophenyl)-1,3,4-oxadiazole, styryl compounds such as 9-(4-diethylaminostyryl) anthracene, carbazole compounds such as polyvinylcarbazole, organopolysilane compound, pyrazoline compounds such as 1-phenyl-3-(p-dimethylaminophenyl) pyrazoline, hydrazone compounds, indole compounds, oxazole compounds, isoxazole compounds, thiazole compounds, thiadiazole compounds, imidazole compounds, pyrazole compounds, and triazole compounds.

These hole transferring materials may be used alone, or two or more kinds of them may be used in combination.

[Dispersion Medium]

In the electrophotosensitive material of the present invention, as the dispersion medium for preparing a coating solution for formation of a photosensitive layer, various organic solvents used in the coating solution for formation of a photosensitive layer can be used. Examples of the organic solvent include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, dioxane, ethylene glycol dimethyl ether, and diethylene glycol dimethyl ether; ketones such as acetone, methyl ethyl ketone, and cylohexanone; esters such as ethyl acetate and methyl acetate; and dimethylformaldehyde, dimethylformamide and dimethyl sulfoxide.

However, in the present invention, at least one organic solvent selected from the group consisting of tetrahydrofuran, dioxane, dioxolane, cyclohexane, toluene, xylene, dichloromethane, dichloroethane and chlorobenzene among the above-mentioned organic solvents is preferably used in order to disperse the respective components, for example, electric charge generating material such as titanyl phthalocyanine, electric charge transferring material and insoluble azo pigment in a stable manner.

[Other Components]

In addition to the respective components described above, conventionally known various additives, for example, antioxidants, radical scavengers, singlet quenchers, degradaton inihibitors such as ultraviolet absorbers, softeners, plasticizers, surface modifiers, excipients, thickeners, dispersion stabilizers, waxes, acceptors and donors can be incorporated in the coating solution for formation of a photosensitive layer as far as electrophotographic characteristics are not adversely affected. For the purpose of improving the sensitivity of the photosensitive layer, publicly known sensitizers such as terphenyl, halonaphthoquinones and acenaphthylene may be used in combination with the electric charge generating material. To improve the dispersibility of the electric charge transferring material and electric charge generating material, and the smoothness of the surface of the photosensitive layer, surfactants and leveling agents may be added.

[Conductive Substrate]

As the conductive substrate on which the photosensitive layer is formed, for example, various materials having the conductivity can be used, and examples thereof include conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength during service.

[Method of Producing Electrophotosensitive Material]

The single-layer type electrophotosensitive material of the present invention is obtained by dispersing titanyl phthalocyanine as the electric charge generating material, the electron transferring material and/or the hole transferring material, the insoluble azo pigment and the binder resin in a proper dispersion medium, coating the conductive substrate with the resulting coating solution for formation of a photosensitive layer, and drying the coating solution to form a photosensitive layer.

In the coating solution for formation of a photosensitive layer, the electric charge generating material is preferably incorporated in the amount within a range from 0.1 to 50 parts by weight, and preferably from 0.5 to 30 parts by weight, based on 100 parts by weight of the binder resin.

The insoluble azo pigment is preferably incorporated in the amount within a range from 0.1 to 50 parts by weight, and more preferably from 0.5 to 30 parts by weight, based on 100 parts by weight of the binder resin so that the ratio of the insoluble azo pigment to the electric charge generating material is within the range described above.

The electron transferring material is preferably incorporated in the amount within a range from 5 to 200 parts by weight, and more preferably from 10 to 100 parts by weight, based on 100 parts by weight of the binder resin.

The hole transferring material is preferably incorporated in the amount within a range from 5 to 500 parts by weight, and more preferably from 25 to 200 parts by weight, based on 100 parts by weight of the binder resin.

When using the electron transferring material in combination with the hole transferring material, the total amount of the electron transferring material and the hole transferring material is preferably within a range from 20 to 500 parts by weight, and more preferably from 30 to 200 parts by weight, based on 100 parts by weight of the binder resin.

The thickness of the photosensitive layer obtained by coating of the coating solution for formation of a photosensitive layer is preferably set within a range from 5to 100 μm, and particularly preferably from 10 to 50 μm.

A barrier layer may be formed between the conductive substrate and photosensitive layer as far as the characteristics of the photosensitive material are not adversely affected, though it is not specifically limited in the present invention. Also a protective layer maybe formed on the surface of the photosensitive material.

In case the photosensitive layer is formed by a coating method, a dispersion is prepared by dispersing and mixing the electric charge generating material, the electric charge transferring material, the insoluble azo pigment and the binder resin, together with proper solvents, using a known method such as roll mill, ball mill, attritor, paint shaker, ultrasonic dispersing equipment or the like and the conductive substrate is coated with the resulting dispersion by a known means, and then the dispersion is dried.

EXAMPLES

The following Example and Comparative Examples further illustrate the present invention.

[Production of Single-Layer Type Electrophotosensitive Material]

Example 1

As the electric charge generating material, titanyl phthalocyanine obtained by the method described in Preparation Example 1 of Japanese Published Unexamined Patent Application (Kokai Tokkyo Koho) No. 2000-181531 [see the following formula (TiOPc)]. The method of producing titanyl phthalocyanine is as follows.

Synthesis of titanyl phthalocyanine compound: In a flask wherein the atmosphere was replaced by argon, 25 g of 1,3-diiminoisoindoline, 22 g of titanium tetrabutoxide and 300 g of diphenylmethane were mixed and heated to 150° C. While vapor generated in the flask was distilled out of the reaction system, the temperature in the system was raised to 215° C. Then, the mixture was reacted by stirring for additional four hours, with the temperature kept at 215° C. After the completion of the reaction, the temperature in the system was cooled to 150° C. and the reaction mixture was filtered through a glass filter. The resulting solid was washed in turn with N,N-dimethylformamide and methanol, and then vacuum-dried to obtain 24 g of a violet solid.

Pigmentation pretreatment: 10 g of the violet solid obtained above was added in 100 ml of N,N-dimethylformamide, followed by a stirring treatment with heating to 130° C. for two hours. After two hours have passed, heating was terminated and the reaction solution was cooled to room temperature (23±1° C.) and stirring was also terminated. The solution was subjected to a stabilization treatment by allowing to stand in this state for 12 hours. The stabilized solution was filtered through a glass filter, and then the resulting solid was washed with methanol and vacuum-dried to obtain 9.85 g of a crude crystal of a titanyl phthalocyanine.

Pigmentation treatment: 5 g of the crude crystal of the titanyl phthalocyanine obtained above was dissolved in 100 ml of a mixed solution of dichloromethane and trifluoroacetic acid (volume ratio: 4:1). After the resulting solution was added dropwise in a mixed poor solvent of methanol and water (volume ratio: 1:1), the solution was stirred at room temperature for 15 minutes, and then allowed to stand at room temperature for 30 minutes, thereby to recrystallize the solution. The solution was filtered through a glass filter. After washed with water until the wash becomes neutral without drying, the resulting solid was dispersed in 200 ml of chlorobenzene, with water contained therein, and then stirred for one hour. The resulting solution was filtered through a glass filter and the resulting solid was vacuum-dried at 50° C. for five hours to obtain 4.2 g of a non-substituted titanyl phthalocyanine (TiOPc) crystal (blue powder) represented by the following formula (TiOPc):

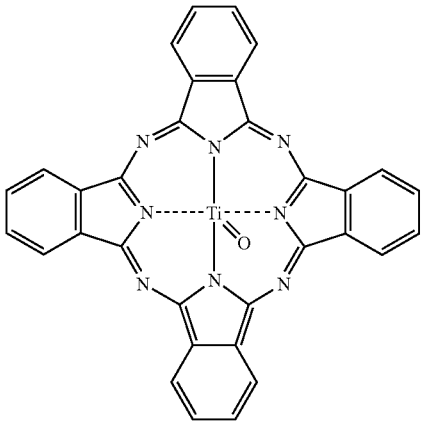

(TiOPc)

TiOPc is so-called Y type titanyl phthalocyanine and has a main diffraction peak at a Bragg angle (2 θ±0.2°)=27.2 in an X-ray diffraction spectrum. It had no peak at a Bragg angle (2 θ±0.2°)=26.2. The measurement results of the X-ray diffraction spectrum are shown in FIG. 1.

Figure 2:
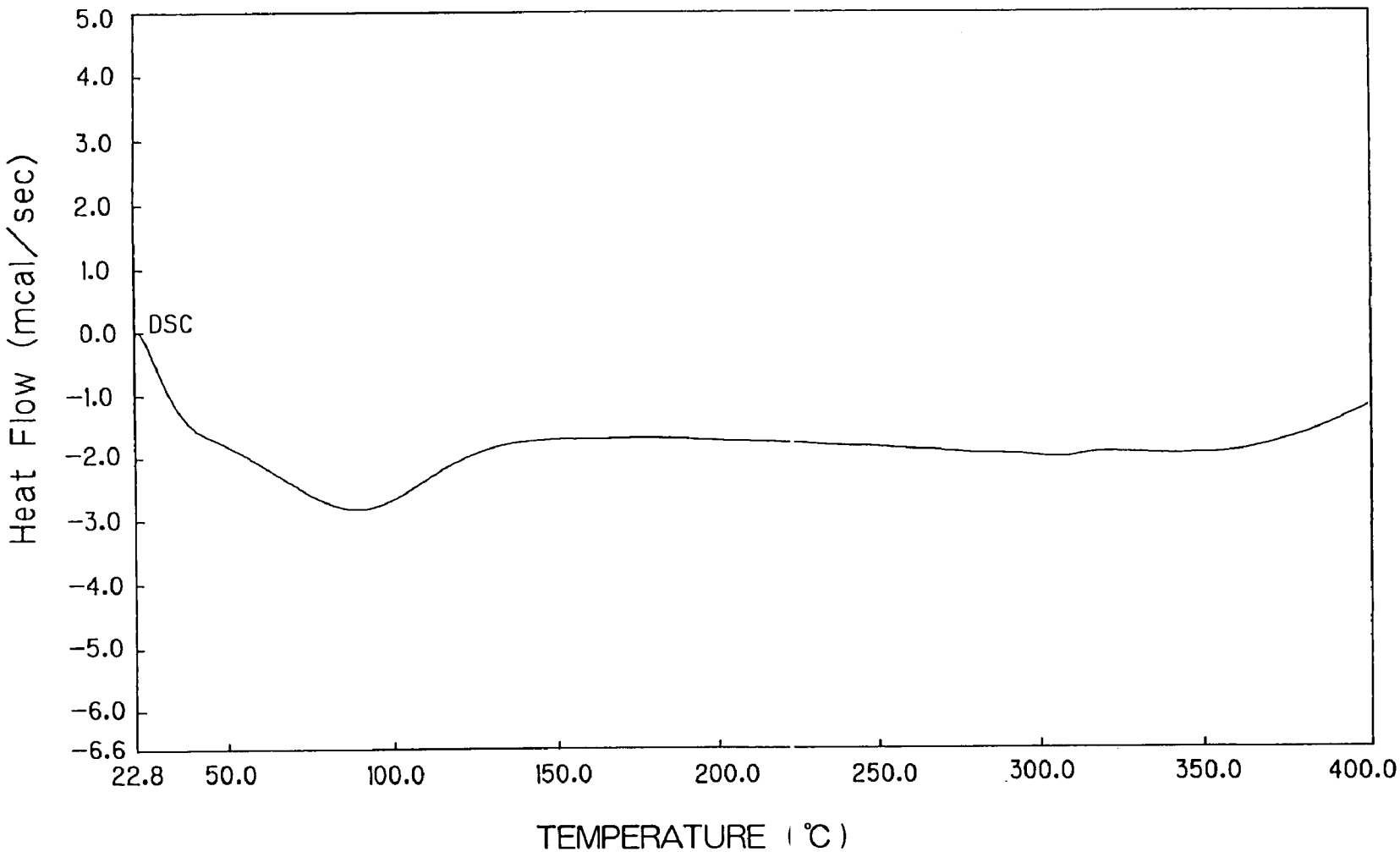
FIG. 2 is a graph showing the results of differential scanning calorimetry of Y type TiOPc used in the Examples.
Figure 3:
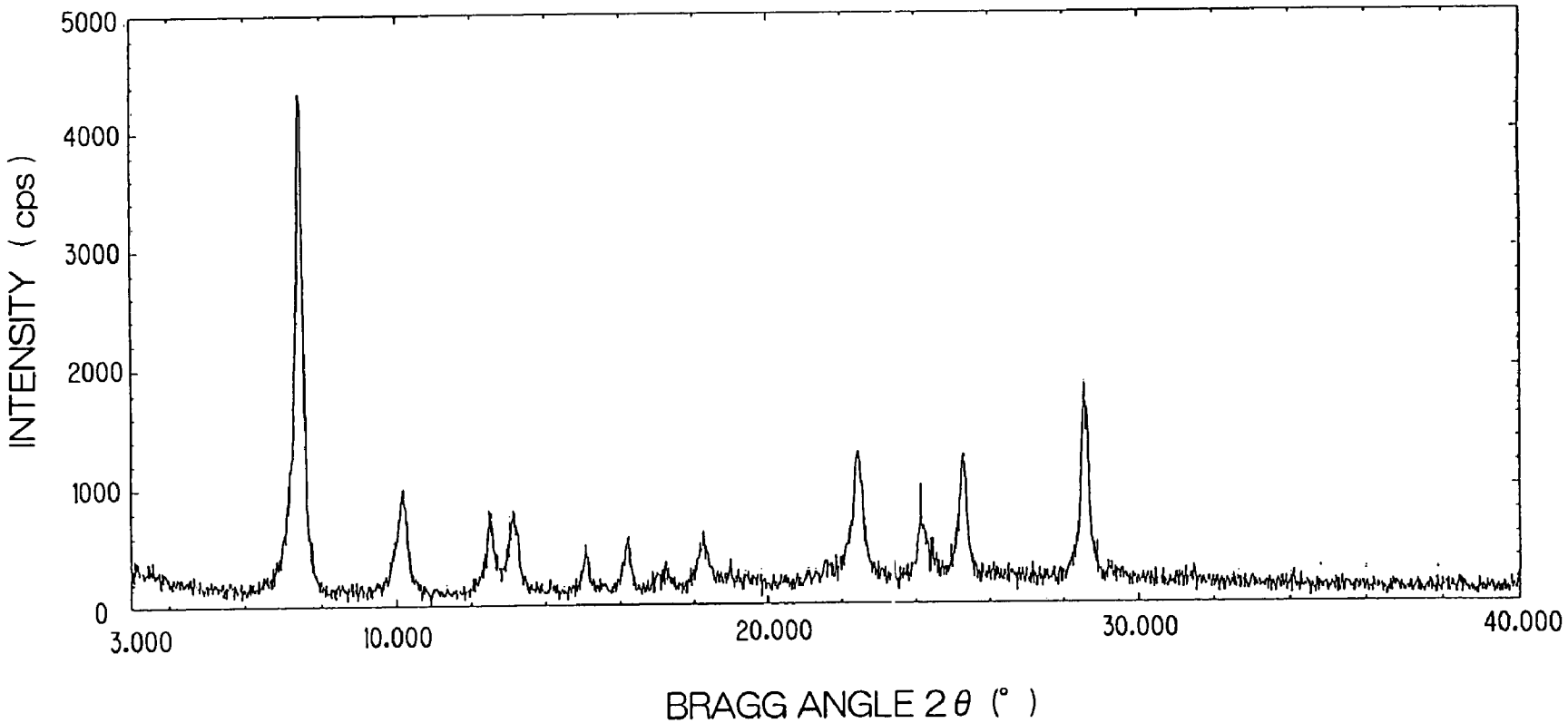
FIG. 3 is a graph showing an X-ray diffraction spectrum of α type TiOPc used in Example 13.

TiOPc did not have an endothermic peak except for a peak associated with evaporation of adsorbed water in differential scanning calorimetry during heating from 50° C. to 400° C. The measurement results of differential scanning calorimetry are shown in FIG. 2.

As the hole transferring material, a bisstilbene derivative represented by the formula (HTM-1):

(HTM-1)

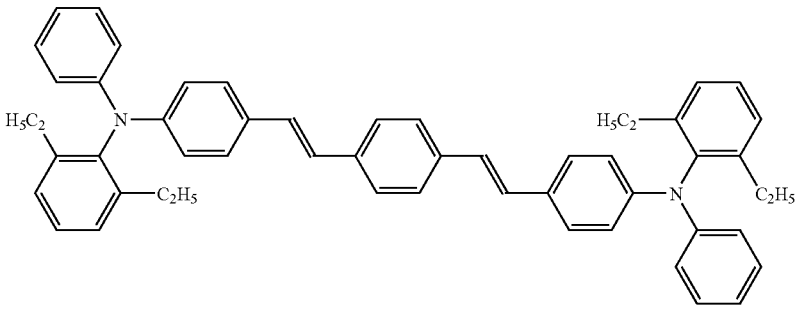

was used.

As the electron transferring material, an azoquinone derivative represented by the formula (ETM-1):

(ETM-1)

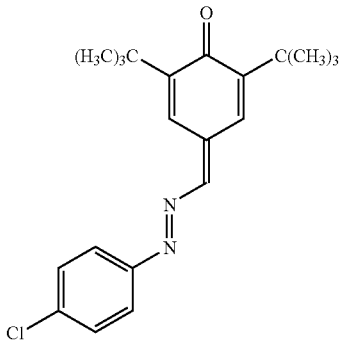

and a diphenoquinone derivative represented by the formula (ETM-2)

(ETM-2)

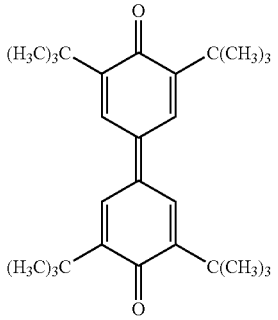

were used.

As the azo pigment, C.I. Pigment Yellow 49 (which belongs to a monoazo pigment of the general formula (1) wherein $X^1$ represents a methyl group substituted on the 2-position of the benzene ring, $X^2$ represents a chlorine atom substituted on the 4-position of the benzene ring, $R^1$ and $R^4$ represent a methoxy group, and $R^3$ represents a chlorine atom) was used.

As the leveling agent, silicone oil [dimethyl silicone oil, the trade name of"KF-96-50CS"] manufactured by SHIN-ETSU CHEMICAL CO., LTD. was used.

As the binder resin, a polycarbonate resin (reduced viscosity-average molecular weight: 20000) containing a repeasting unit represented by the following formula (ru-1) and a repeating unit represented by the following formula (ru-2) in a ratio of 85:15 (molar ratio) was used.

(ru-1)

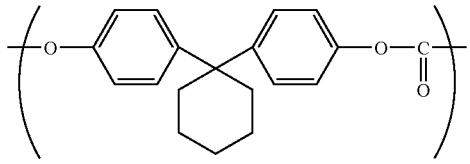

(ru-2)

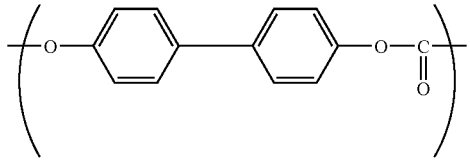

100 parts by weight of the binder resin (polycarbonate resin), 3.2 parts by weight of the electric charge generating material (Y-TiOPc), 2.4 parts by weight of the insoluble azo pigment (C.I. Pigment Yellow 49), 50 parts by weight of the hole transferring material (HTM-1), 15 parts by weight of the electron transferring material (azoquinone derivative, ETM-1), 10 parts by weight of the electron transferring material (dipehnoquinone derivative, ETM-2), 0.1 parts by weight of the leveling agent and 420 parts by weight of tetrahydrofuran as the dispersion medium were mixed and dispersed using an ultrasonic dispersing apparatus.

After the resulting coating solution for formation of a photosensitive layer was allowed to stand for 10 days, an aluminum tube as the conductive substrate was coated with the coating solution to obtain an electrophotosensitive material having a 28 μm thick photosensitive layer.

Example 2 to 12

In the same manner as in Example 1, except that 2.4 parts by weight of each of azo pigments shown in Table 8 was used in place of C.I. Pigment Yellow 49 as the insoluble azo pigment, single-layer type electrophotosensitive materials were obtained.

As is apparent from C.I. Nos. and compound numbers shown in Table 8, any insoluble azo pigments used in Examples 1 to 12 correspond to any of the monoazo pigment of the general formula (1), the disazo pigments of the general formulas (2) to (4) and the disazo condensed pigments of the general formulas (5) and (6).

Comparative Example 1

In the same manner as in Example 1, except the insoluble azo pigment was not incorporated, a single-layer type electrophotosensitive material was obtained.

Comparative Example 2

In the same manner as in Example 1, except that 2.4 parts by weight of a bisazofluorenone pigment (azo pigments) represented by the formula (c-1):

(c-1)

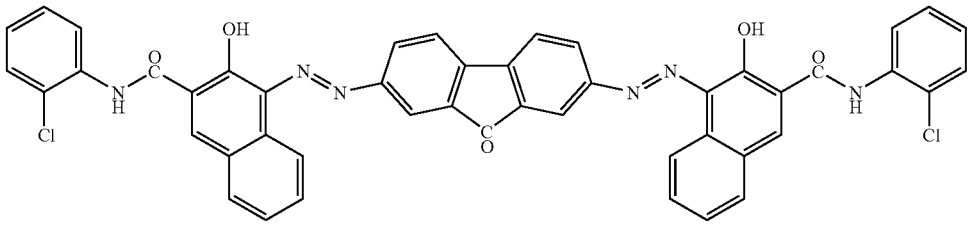

was used in place of the insoluble azo pigment (C.I. Pigment Yellow 49), a single-layer type electrophotosensitive material was obtained.

Comparative Example 3

In the same manner as in Example 1, except that 2.4 parts by weight of a bisazostilbene pigment (azo pigments) represented by the formula (c-2):

(c-2)

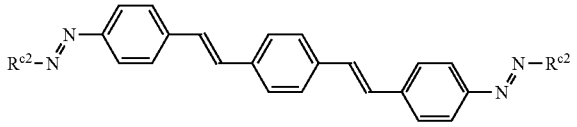

wherein $R^{c2}$ represents a group represented by the formula:

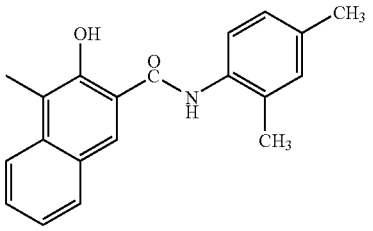

was used in place of the insoluble azo pigment (C.I. Pigment Yellow 49), a single-layer type electrophotosensitive material was obtained.

Comparative Example 4

In the same manner as in Example 1, except that 2.4 parts by weight of azo pigments represented by the formula (c-3):

(c-3)

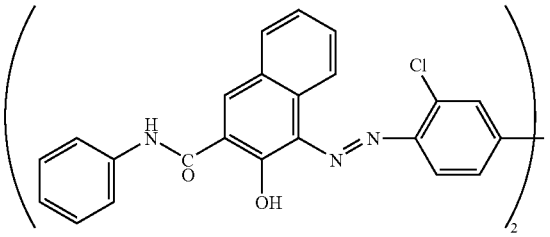

was used in place of the insoluble azo pigment (C.I. Pigment Yellow 49), a single-layer type electrophotosensitive material was obtained.

Comparative Example 5

In the same manner as in Example 1, except that 2.4 parts by weight of trisazotriphenylamine (azo pigments) represented by the formula (c-4):

(c-4)

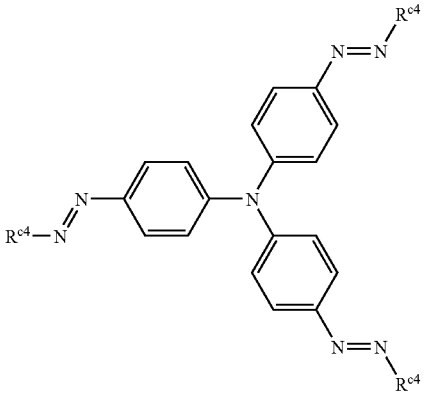

wherein $R^{c4}$ represents a group represented by the formula:

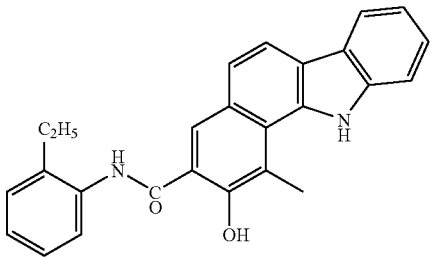

was used in place of the insoluble azo pigment (C.I. Pigment Yellow 49), a single-layer type electrophotosensitive material was obtained.

Comparative Example 6

In the same manner as in Example 1, except that 2.4 parts by weight of C.I. Pigment Yellow No. 151 (which has the same skeleton as that of the monoazo pigment of the general formula (1) and has an OH group in the molecule) represented by the formula:

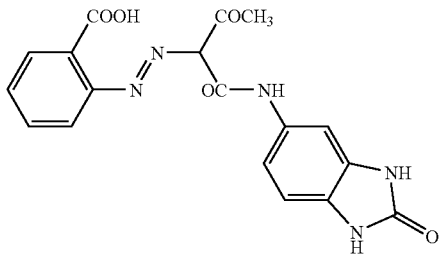

in place of the insoluble azo pigment (C.I. Pigment Yellow 49), a single-layer type electrophotosensitive material was obtained.

Any insoluble azo pigments used in Comparative Examples 2 to 6 have an OH group in the molecule.

Example 13

In the same manner as in Example 10, except that α type TiOPc was used as the electric charge generating material in place of Y type TiOPc, a single-layer type electrophotosensitive material was obtained.

This α type TiOPc had a main diffraction peak at a Bragg angle (2 θ±0.2°)=7.6° and 28.6° in an X-ray diffraction spectrum. The measurement results of the X-ray diffraction spectrum are shown in FIG. 2.

Example 14

In the same manner as in Example 11, except that α type TiOPc was used as the electric charge generating material in place of Y type TiOPc, a single-layer type electrophotosensitive material was obtained.

Example 15

In the same manner as in Example 12, except that α type TiOPc was used as the electric charge generating material in place of Y type TiOPc, a single-layer type electrophotosensitive material was obtained.

As is apparent from C.I. Nos. and compound numbers shown in Table 9, any insoluble azo pigments used in Examples 13 to 15 correspond to any of the monoazo pigment of the general formula (1), the disazo pigments of the general formulas (2) to (4) and the disazo condensed pigments of the general formulas (5) and (6).

Comparative Example 7

In the same manner as in Comparative Example 1, except that α type TiOPc was used as the electric charge generating material in place of Y type TiOPc, a single-layer type electrophotosensitive material was obtained.

Comparative Example 8

In the same manner as in Comparative Example 2, except that α type TiOPc was used as the electric charge generating material in place of Y type TiOPc, a single-layer type electrophotosensitive material was obtained.

The insoluble azo pigment used in Comparative Example 8 has an OH group in the molecule.

[Evaluation of Physical Properties of Insoluble Azo Pigment]

With respect to the insoluble azo pigment and Y type TiOPc used in Example 1, an absorbance at a wavelength of 600 nm and an absorbance at a wavelength of 780 nm were measured. Then, a ratio of the absorbance of the insoluble azo pigment to the absorbance (1) of the Y type TiOPc was calculated and was taken as an absorbance ratio. In the same manner, a ratio of the absorbance of the insoluble azo pigments used in Examples 2 to 12 and Comparative Examples 1 to 6 to the absorbance of the Y type TiOPc was also calculated.

With respect to the insoluble azo pigment and α type TiOPc used in Example 13, an absorbance at a wavelength of 600 nm and an absorbance at a wavelength of 780 nm were measured. Then, a ratio of the absorbance of the insoluble azo pigment to the absorbance (1) of the α type TiOPc was calculated and was taken as an absorbance ratio. In the same manner, a ratio of the absorbance of the insoluble azo pigments used in Examples 14 to 15 and Comparative Examples 7 to 8 to the absorbance of the α type TiOPc was also calculated.

The absorbances of the insoluble azo pigment, Y type TiOPc and α type TiOPc were measured by the following method.

100 Parts by weight of Z type polycarbonate [manufactured by TEIJIN CHEMICALS LTD under the trade name of Panlite TS2050], 1 part by weight of an insoluble azo pigment, Y type TiOPc or α type TiOPc, and 0.1 parts by weight of silicone oil [dimethyl silicone oil, the trade name of "KF-96-50CS"] manufactured by SHIN-ETSU CHEMICAL CO., LTD. were dissolved in 450 parts by weight of tetrahydrofuran. A film having a thickness of 1 μm was formed by coating a ϕ30 mm aluminum tube with the coating solution thus obtained, using a blade whose surface is coated with a fluororesin [Teflon (R)]. The film was peeled off from the aluminum tube to obtain a specimen and an absorbance in a visible range of the specimen was measured in a thickness direction using a spectral colorimeter.

The measurement results of the absorbance ratio are shown in Tables 8 and 9.

[Evaluation of Physical Properties of Photosensitive Materials]

(1) Measurement of Light Potential

The electrophotosensitive materials obtained in the above Examples and Comparative Examples were fit with a modified electrostatic copying machine [manufactured by KYOCERA MITA CORPORATION under the trade name of "Creage 7325"] and charged to +800 V, and then a surface potential (light potential) upon exposure to red semiconductor laser beam having a wavelength of 780 nm was measured.

The value of the light potential is preferably +130 V or less. When the value is +130 V or more, the electrophotosensitive material is inferior in sensitivity.

(2) Evaluation of NOx Resistance

The electrophotosensitive materials obtained in the above Examples and Comparative Examples were fit with the above-mentioned modified electrostatic copying machine ("Creage7325") and charged while setting a grid voltage so as to adjust the surface potential to +800 V. Then, the electrophotosensitive materials obtained in the above Examples and Comparative Examples were exposed to 24 ppm of a NOx gas atmosphere (50 hours) and the surface potential was measured under the same conditions as those in case of the grid potential set before exposure. Furthermore, a change in surface potential (V) before and after exposure to the NOx gas and the NOx resistance of the electrophotosensitive material was evaluated. For example, when the surface potential before exposure to the NOx gas is 800 V and the surface potential after exposure to the NOx gas is 690 V, the NOx resistance is evaluated as −110 V. The change in surface potential before and after exposure to the NOx gas is preferably −150 V or less (decrease in surface potential after exposure is preferably less than 150 V). When the change exceeds −150V (it exceeds −150 V after exposure and then decreases), the electrophotosensitive material is inferior in NOx resistance.

The above results are shown in Tables 8 and 9.

TABLE 8

| | Insoluble azo pigment | Absorbance ratio 600 nm | Absorbance ratio 780 nm | Physical properties of photosensitive material: Light potential (V) | Physical properties of photosensitive material: NOx resistance (V) |
|---|---|---|---|---|---|
| CGM: Y-TiOPc | | | | | |
| Example 1 | Yellow 49 | <0.01 | <0.01 | 110 | −102 |
| Example 2 | Yellow 98 | <0.01 | <0.01 | 105 | −100 |
| Example 3 | Yellow 120 | <0.01 | <0.01 | 107 | −98 |
| Example 4 | Yellow 13 | <0.01 | <0.01 | 111 | −94 |
| Example 5 | Yellow 180 | <0.01 | <0.01 | 110 | −103 |
| Example 6 | Yellow 81 | <0.01 | <0.01 | 103 | −107 |
| Example 7 | Yellow 16 | 0.02 | <0.01 | 101 | −110 |
| Example 8 | Yellow 77 | <0.01 | <0.01 | 108 | −95 |
| Example 9 | Yellow 155 | <0.01 | <0.01 | 109 | −121 |
| Example 10 | Yellow 93 | <0.01 | <0.01 | 120 | −116 |
| Example 11 | Yellow 95 | <0.01 | <0.01 | 114 | −112 |
| Example 12 | Azo pigments (6-1) | <0.01 | <0.01 | 111 | −101 |
| Comparative Example 1 | — | — | — | 275 | −101 |
| Comparative Example 2 | Azo pigments (c-1) | 0.1 | <0.01 | 155 | −230 |
| Comparative Example 3 | Azo pigments (c-2) | 0.1 | <0.01 | 160 | −220 |
| Comparative Example 4 | Azo pigments (c-3) | 0.1 | <0.01 | 151 | −199 |
| Comparative Example 5 | Azo pigments (c-4) | 1.1 | 0.7 | 192 | −221 |
| Comparative Example 6 | Yellow 151 | <0.01 | <0.01 | 151 | −185 |

TABLE 9

| | Insoluble azo pigment | Absorbance ratio 600 nm | Absorbance ratio 700 nm | Physical properties of photosensitive material: Light potential (V) | Physical properties of photosensitive material: NOx resistance (V) |
|---|---|---|---|---|---|
| CGM: α-TiOPc | | | | | |
| Example 13 | Yellow 93 | <0.01 | <0.01 | 130 | −118 |
| Example 14 | Yellow 95 | <0.01 | <0.01 | 125 | −125 |
| Example 15 | Azo pigments (6-1) | <0.01 | <0.01 | 122 | −109 |
| Comparative Example 7 | — | — | — | 159 | −122 |
| Comparative Example 8 | Azo pigments (c-1) | — | <0.01 | 135 | −222 |

As is apparent from Tables 8 and 9, the electrophotosensitive materials containing phthalocyanine as the electric charge material and a predetermined insoluble azo pigment in the photosensitive layer of Examples 1 to 15 had sufficiently low light potential and good NOx resistance. Moreover, the electrophotosensitive materials were excellent in charge stability under the high temperature atmosphere and weatherability.

On the other hand, the electrophotosensitive materials using azo pigments having an OH group in the molecule or azo pigments which exhibit definite sensitivity in a wavelength range of an exposure light source or in an absorption range of Y type or α type TiOPc as the electric charge generating material (exhibit an absorbance which is ⅓ or more relative to the absorbance of the electric charge generating material), as is apparent from the measurement results of an absorbance ratio, of Comparative examples 2 to 6 and8 had high light potential and insufficient NOx resistance. Moreover, the electrophotosensitive materials were insufficient in charge stability under the high temperature atmosphere and weatherability.

Also the electrophotosensitive materials containing no azo pigments of Comparative Examples 1 and 7 had high light potential and poor sensitivity.

We claim:

1. A single-layer type electrophotosensitive material comprising a conductive substrate and a photosensitive layer containing an electric charge generating material, an electron transferring material and a hole transferring material as electric charge transferring materials, an insoluble azo pigment and a binder resin provided on the conductive substrate, wherein the electric charge generating material is phthalocyanine and the insoluble azo pigment has no OH group in the molecule, and an absorbance of the insoluble azo pigment in an absorption wavelength range of the electric charge generating material is ⅓ or less of an absorbance in the wavelength of the electric charge generating material, the phthalocyanine and the insoluble azo pigment being disposed together in the photosensitive layer; wherein the electron transferring material is incorporated in the amount within a range of from 5 to 200 parts by weight based on 100 parts by weight of the binder resin, and the hole transferring material is incorporated in the amount within a range of from 5 to 500 parts by weight based on 100 parts by weight of the binder resin; further wherein the insoluble azo pigment is a monoazo pigment represented by the general formula (1):

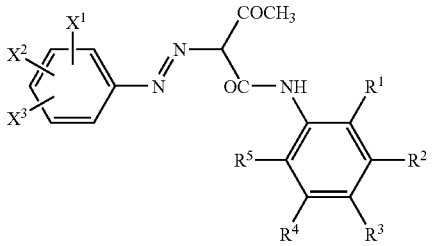

(1)

in the formula (1), $X^1$ to $X^3$ are the same or different and represent a nitro group, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, a group: —$CONHR^6$, or a group: —$SO^2NHPh$, $R^1$ to $R^5$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^2$ and $R^3$ may be combined with each other to form an ureylene group, $R^6$ and $R^7$ are the same or different and represent a hydrogen atom, an alkyl group having 1 to 3 carbon atoms, or a phenyl group, and Ph represents a phenyl group;

a disazo pigment represented by the general formula (2):

(2)

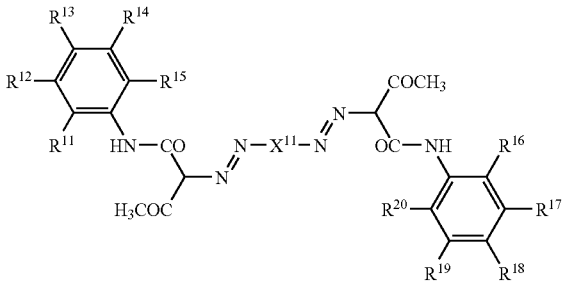

in the formula (2), $X^{11}$ represents the general formula (22):

(22)

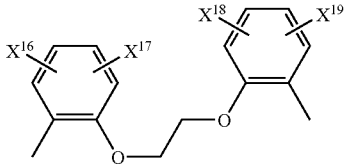

in the formula (22), $X^{16}$ to $X^{19}$ are the same or different and represent a chlorine atom, an alkyl group having 1 to 3 carbon atoms, a perfluoroalkyl group having 1 to 3 carbon atoms, or an alkoxy group having 1 to 3 carbon atoms, $R^{11}$ to $R^{20}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{12}$ and $R^{13}$ and/or $R^{17}$ and $R^{18}$ may be combined with each other to form an ureylene group, and $R^7$ represents a hydrogen atom, an alkyl group having 1 to 3 carbon atoms, or a phenyl group;

a disazo pigment represented by the general formula (3):

(3)

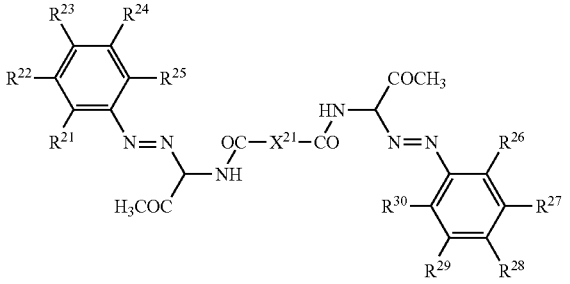

in the formula (3), $X^{21}$ represents the general formula (31) or the general formula (32):

(31)

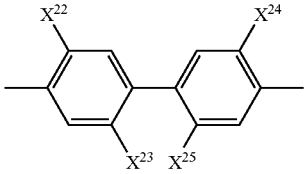

-continued (32)

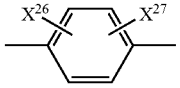

in the formula (31), $X^{22}$ to $X^{25}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms and, in the formula (32), $X^{26}$ and $X^{27}$ are the same or different and represent a chlorine atom, an alkyl group having 1 to 3 carbon atoms, a perfluoroalkyl group having 1 to 3 carbon atoms, or an alkoxy group having 1 to 3 carbon atoms, $R^{21}$ to $R^{30}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{22}$ and $R^{23}$ and/or $R^{27}$ and $R^{28}$ may be combined with each other to form an ureylene group, and $R^7$ represents a hydrogen atom, an alkyl group having 1 to 3 carbon atoms, or a phenyl group;

a disazo pigment represented by the general formula (4):

(4)

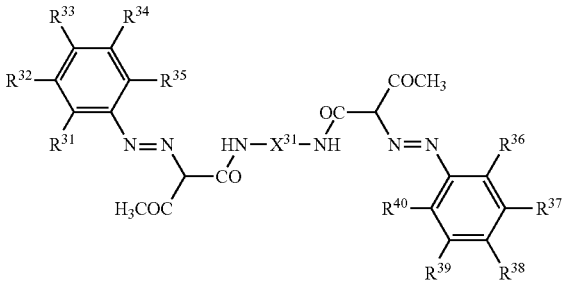

in the formula (4), $X^{31}$ represents the general formula (41) or the general formula (42):

(41)

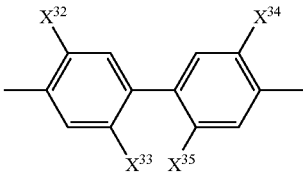

(42)

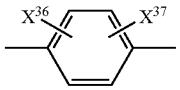

in the formula (41), $X^{32}$ to $X^{35}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms and, in the formula (42), $X^{36}$ and $X^{37}$ are the same or different and represent a chlorine atom, an alkyl group having 1 to 3 carbon atoms, a perfluoroalkyl group having 1 to 3 carbon atoms, or an alkoxy group having 1 to 3 carbon atoms, $R^{31}$ to $R^{40}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{32}$ and $R^{33}$ and/or $R^{37}$ and $R^{38}$ may be combined with each other to form an ureylene group, and $R^7$ represents a hydrogen atom, an alkyl group having 1 to 3 carbon atoms or a phenyl group;

a disazo condensed pigment represented by the general formula (5):

(5)

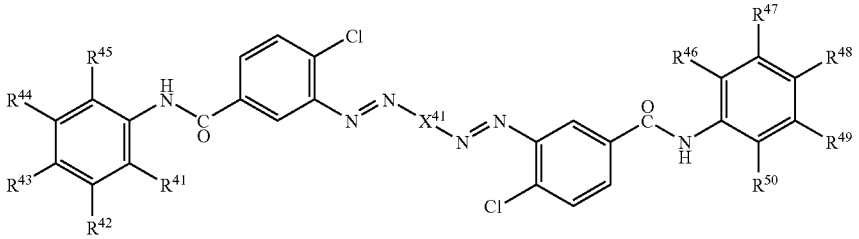

in the formula (5), $X^{41}$ represents the general formula (51):

(51)

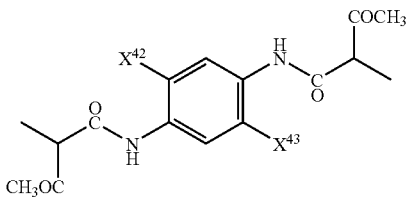

in the formula (51), $X^{42}$ and $X^{43}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms, $R^{41}$ to $R^{50}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{42}$ and $R^{43}$ and/or $R^{47}$ and $R^{48}$ may be combined with each other to form an ureylene group, and $R^7$ is as defined above; or a disazo condensed pigment represented by the general formula (6):

(6)

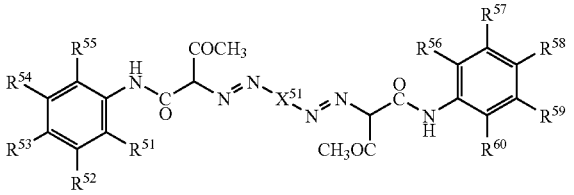

in the formula (6), $X^{51}$ represents the formula (61):

(61)

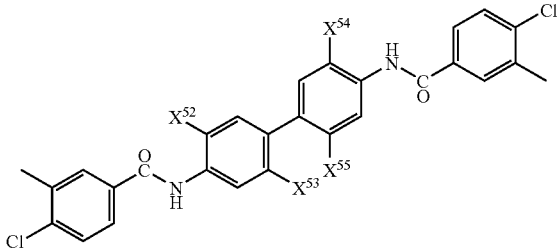

in the formula (61), $X^{52}$ to $X^{55}$ are the same or different and represent a hydrogen atom, a chlorine atom, an alkyl group having 1 to 3 carbon atoms, a perfluoroalkyl group having 1 to 3 carbon atoms, or an alkoxy group having 1 to 3 carbon atoms, $R^{51}$ to $R^{60}$ are the same or different and represent a hydrogen atom, a chlorine atom, an alkyl group having 1 to 3 carbon atoms, a perfluoroalkyl group having 1 to 3 carbon atoms, an alkoxy group having 1 to 3 carbon atoms, an alkoxycarbonyl group having 1 to 2 carbon atoms, or a group: —$NHCOR^7$, provided that $R^{52}$ and $R^{53}$ and/or $R^{57}$ and $R^{58}$ may be combined with each other to form an ureylene group, and $R^7$ as defined above.

2. The electrophotosensitive material according to claim 1, wherein the binder resin is at least one resin selected from the group consisting of polycarbonate, polyester, polyarylate, polystyrene and polymethacrylate ester.

3. The electrophotosensitive material according to claim 1, wherein the phthalocyanine is α type titanyl phthalocyanine having each main diffraction peak at a Bragg angle (2θ±0.2°)=7.6° and 28.6° in an X-ray diffraction spectrum, or Y type titanyl phthalocyanine having a main diffraction peak at a Bragg angle (2θ±0.2°)=27.2.

4. The electrophotosensitive material according to claim 1, wherein the phthalocyanine is titanyl phthalocyanine and does not have an endothermic peak except for a peak associated with evaporation of adsorbed water in differential scanning calorimetry during heating from 50°C. to 400°C.

5. The electrophotosensitive material according to claim 1, wherein the photosensitive layer is obtained by forming a film using a coating solution containing the electric charge generating material, the electric charge transferring materials, the insoluble azo pigment and the binder resin to form a film, and a dispersion medium of the coating solution is at least one organic solvent selected from the group consisting of tetrahydrofuran, dioxane, dioxolane, cyclohexanone, toluene, xylene, dichloromethane, dichloroethane and chlorobenzene.

* * * * *